United States Patent [19]

Shenoy

[11] Patent Number: 4,585,332

[45] Date of Patent: Apr. 29, 1986

[54] ELECTROPHOTOGRAPHIC PRINTING MACHINE WITH MEANS FOR SENSING SIZE OF DOCUMENT

[75] Inventor: Vittal U. Shenoy, Fairport, N.Y.

[73] Assignee: Xerox Corporation, Stamford, Conn.

[21] Appl. No.: 644,585

[22] Filed: Aug. 27, 1984

[51] Int. Cl.[4] ..... G03G 15/00

[52] U.S. Cl. ..... 355/14 R; 355/14 SH; 355/3 SH; 271/154

[58] Field of Search ..... 355/14 SH, 3 SH, 14 R, 355/7, 8, 41, 61, 3 R; 271/227, 258, 261, 265, 152, 153, 154

[56] References Cited

U.S. PATENT DOCUMENTS

| | | | |
|---|---|---|---|
| 3,689,143 | 9/1972 | Case et al. | 355/3 |
| 4,105,327 | 8/1978 | Gibson et al. | 355/59 |
| 4,190,246 | 2/1980 | Sasuga | 355/14 SH X |
| 4,277,163 | 7/1981 | Ikesue et al. | 355/14 |
| 4,303,332 | 12/1981 | Sakai | 355/8 X |
| 4,338,020 | 7/1982 | Yukawa et al. | 355/14 SH X |
| 4,341,460 | 7/1982 | Kohyama | 355/13 |
| 4,351,606 | 9/1982 | Franko | 355/14 R |
| 4,456,372 | 6/1984 | Yamauchi | 355/75 |
| 4,478,508 | 10/1984 | Kato et al. | 355/14 R |
| 4,505,574 | 3/1985 | Kurata et al. | 355/8 |
| 4,511,242 | 4/1985 | Ashbee et al. | 355/3 R X |

*Primary Examiner*—A. C. Prescott

*Attorney, Agent, or Firm*—H. Fleischer; J. E. Beck; R. Zibelli

[57] ABSTRACT

An electrophotographic printing machine in which a variable magnification optical system is controlled so that information being reproduced from an original document fits on a copy sheet. The size of the original document is sensed. The device sensing the size of the original document has a minimum number of detectors to measure a maximum number of different size original documents. The size of the copy sheet is compared to the size of the original document and an error signal generated indicative of the difference therebetween. This error signal controls the magnification of the optical system.

13 Claims, 7 Drawing Figures

ELECTROPHOTOGRAPHIC PRINTING MACHINE WITH MEANS FOR SENSING SIZE OF DOCUMENT

This invention relates generally to an electrophotographic printing machine and more particularly to a control system utilizing a minimum number of detectors for adjusting the magnification of a variable magnification optical system used in the electrophotographic printing machine.

Generally, an electrophotographic printing machine includes a photoconductive member which is charged to a substantially uniform potential to sensitize the surface thereof. The charged portion of the photoconductive surface is exposed to a light image of an original document being reproduced. This records an electrostatic latent image on the photoconductive member corresponding to the information contained within the original document. After recording the electrostatic latent image on the photoconductive member, the latent image is developed by bringing a developer mixture into contact therewith. This forms a powder image on the photoconductive member which is subsequently transferred to a copy sheet. Finally, the copy sheet is heated to permanently affix the powder image thereto in image configuration.

In a typical variable magnification optical system, the operator determines the size of the information reproduced from the original document onto the copy sheet. The copies may represent a magnified or reduced image of the information on the original document. However, there generally is no assurance that the information contained on the original document will be capable of fitting on the copy sheet for the desired magnification or reduction selected by the operator. Hereinbefore, detectors have been employed to measure the size of the original document and that of the copy sheet. These detectors have then sent signals to logic circuitry, which, in turn, has developed an error signal for controlling the magnification of the optical system. In this way, magnification of the optical system has been adjusted to insure that the information being reproduced on the copy sheet is of the correct size. However, systems of this type have previously utilized a multitude of detectors and have in no way minimized the number of detectors employed. Thus, it is highly desirable to be capable of optimizing the number of detectors as a function of the size of the original documents being reproduced.

Various approaches have been devised to detect the size of the original documents and to adjust the magnification and/or reduction capabilities of the optical system. The following disclosures appear to be relevant:

U.S. Pat. No.: 3,689,143
Patentee: Case et al.
Issued: Sept. 5, 1982
U.S. Pat. No.: 4,105,327
Patentee: Gibson et al.
Issued: Aug. 8, 1978
U.S. Pat. No.: 4,277,163
Patentee: Ikesue et al.
Issued: July 7, 1981
U.S. Pat. No. 4,341,460
Patentee: Kohyama
Issued: July 27, 1982
U.S. Pat. No. 4,351,606
Patentee: Franko Issued: Sept. 28, 1982
U.S. Pat. No. 4,456,372
Patentee: Yamauchi
Issued: July 26, 1984

The relative portions of the foregoing disclosures may be briefly summarized as follows:

Case et al. discloses an array of document sensing devices including photocells and lamps which detect the presence of a document after the operator inserts the document on a document drum of a printing machine. As the size of a particular document is sensed, logic circuitry selects the appropriate magnification corresponding to the size of the copy sheets.

Gibson et al. describes a continuously variable optical system for use in a document copier. Indicators are motor driven by actuation of a control switch by the operator to correspond in size to that of the document. Movement of the indicators automatically adjusts the magnification of the optical system to insure that the entire document being copied will fit on the copy sheet.

Ikesue et al. discloses an electrostatic copying machine wherein sensors detect the vertical and horizontal lengths of a document on the platen and compare these lengths with those of the copy sheets. The reduction ratio of the optical system is adjusted so that the light image of the maximum length of the document is substantially equal to the corresponding length of the copy sheet. The sensors may be photosensors, micro switches, or the like, which are spaced from each other parallel to the right edge of the platen extending from the lower right corner thereof. Similarly, sensors are spaced from each other parallel to the lower edge of the platen leading from the lower right corner of the platen.

Kohyama describes an electronic copying machine having a light emitter and a light sensor positioned beneath an original paper holder. A light sensor is located so that it receives light from the lid covering the original paper in the holder when one size paper is used and from the paper being copied when the paper is of a second size. The electrical signal from the light sensor is transmitted to a time counter which actuates one of two sheet feeders to advance the appropriately sized copy sheet to the transfer station of the copying machine.

Franko discloses an electrophotographic printing machine in which the size of the original document and copy sheet are sensed and compared. The magnification of the optical size is adjusted so that the indicia on the original document fit on the copy sheet.

Yamauchi describes as conventional, sensors arranged at fixed positions on the platen cover for detecting document size. In Yamauchi, a sensor bar is rotated in a horizontal plane beneath the platen to detect the light reflected from the original document. The length of time that reflected light is sensed indicates the size of the original document.

In accordance with the features of the present invention, there is provided an electrophotographic printing machine of the type having a platen for supporting an original document thereon. A photoconductive member is arranged to have at least a portion of the surface thereof charged. A variable magnification optical system is adapted to expose the charged portion of the photoconductive member to a light image of the original document recording an electrostatic latent image thereon. Means develop the electrostatic latent image to form a toner powder image on the photoconductive member. Means transfer the toner powder image from the photoconductor member to a copy sheet. Means sense the size of the original document. The sensing means comprises a minimum number of detectors mounted fixedly relative to the original document supported on the platen to measure a maximum number of different size original documents. Means measure the size of the copy sheet. Means are provided for comparing the size of the copy sheet to the size of the original document and generating an error signal indicative of the difference therebetween.

Other aspects of the present invention will be apparent as the following discription proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
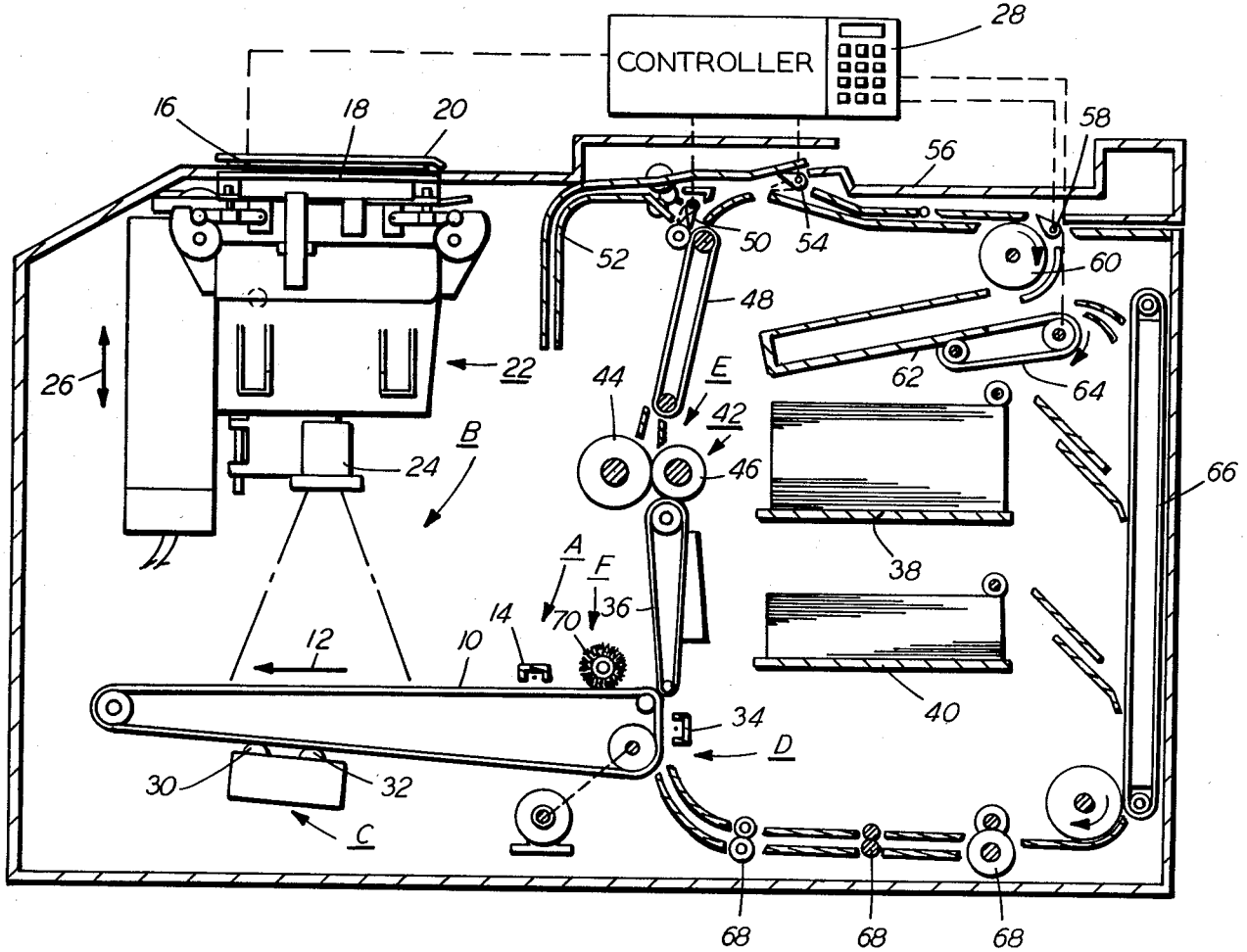
FIG. 1 is a schematic elevational view showing an electrophotographic printing machine employing the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the features of the present invention therein. It will become evident from the following discussion that the technique of minimizing the number of detectors employed to measure the size of a maximum number of differently sized original documents is equally well suited for use in a wide variety of printing machines and is not necessarily limited in its application to the particular embodiment shown herein.

Inasmuch as the art of electrophotographic printing is well known, the various processing station employed in the FIG. 1 printing machine will be shown hereinafter schematically and their operation described briefly with reference thereto.

As shown in FIG. 1, the illustrative electrophotographic printing machine employs a belt 10 having a photoconductive surface thereon. Preferably, the photoconductive surface is made from a selenium alloy. Belt 10 moves in the direction of arrow 12 to advance successive portions of the photoconductive surface to the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, an original document 16 is positioned face down on transparent platen 18. Cover 20 covers the original document and has detectors therein to indicate the size thereof. The exposure system, indicated generally by the reference numeral 22, includes lamps which illuminate document 16 positioned on transparent platen 18. The light rays reflected from document 16 are transmitted through lens 24. Lens 24 focuses the light image of original document 16 onto the charged portion of the photoconductive surface of belt 10 selectively dissipating the charge thereon. This records an electrostatic latent image on the photoconductive surface which corresponds to the informational areas contained within the original document. Thereafter, belt 10 advances the electrostatic latent image recorded on the photoconductive surface to development station C. Platen 18 is mounted movably and arranged to move in the direction of arrow 26 to adjust the magnification of the original document being reproduced. Lens 24 moves in synchronism therewith so as to focus the light image of original document 16 onto the charged portion of the photoconductive surface of belt 10. Detectors in cover 20 measure the size of the original document disposed on platen 18. The output signal from these detectors is transmitted to controller 28. Controller 28 also receives a signal from the copy sheet trays indicative of the size of the copy sheets. Controller 28 compares the signal corresponding to the size of the original document with that of the signal corresponding to the size of the copy sheet. The resultant error signal is employed to adjust the vertical positioning of both lens 24 and platen 18. In this way, the magnification and/or reduction of the information on the original document is controlled so as to fit onto the copy sheet.

With continued reference to FIG. 1, at development station C, a pair of magnetic brush developer rollers, indicated generally by the reference numerals 30 and 32, advance a developer material into contact with the electrostatic latent image. The latent image attracts toner particles from the carrier granules of the developer material to form a toner powder image on the photoconductive surface of belt 10.

After the electrostatic latent image, recorded on the photoconductive surface of belt 10, is developed, belt 10 advances the toner powder image to transfer station D. At transfer station D, a copy sheet is transported into contact with the toner powder image. Transfer station D includes a corona generating device 34 which sprays ions onto the backside of the copy sheet. This attracts the toner powder image from the photoconductive surface of belt 10 to the sheet. After transfer, conveyor 36 advances the sheet to fusing station E.

The copy sheets are fed from a selected one of trays 38 or 40 to transfer station D. Each of these trays has a magnet located at one end thereof. The magnet actuates one of a plurality of magnetic switches in the printing machine by being placed in contact therewith. Thus, the position of the magnet in the copy sheet tray determines which switch the magnet will actuate. The actuated switch corresponds to the size of the copy sheets in the tray. The magnetic switches are coupled to controller 28. In this way, controller 28 receives the signal from a switch which provides a measurement of the size of the copy sheet in copy sheet trays 38 and 40.

Fusing station E includes a fuser assembly indicated generally by the reference numeral 42, which permanently affixes the transferred powder image to the copy sheet. Preferably, fuser assembly 42 includes a heated fuser roller 44 and a back-up roller 46. The sheet passes between fuser roller 44 and back-up roller 46 with the powder image contacting fuser roller 44. In this manner, the powder image is permanently affixed to the sheet.

After fusing, conveyor 48 transports the sheet to gate 50 which functions as an inverter selecter. Depending upon the position of gate 50, the copy sheet will either be deflected into sheet inverter 52 or bypass sheet inverter 52 and be fed directly to a second decision gate 54. The sheets which bypass inverter 52 turns a 90° corner in the sheet path before reaching gate 54. Gate 54 deflects the sheet directly into an output tray 56 or deflects the sheet into a transport path which carries it to a second decision gate 58. Gate 58 either passes the sheet directly on without inversion into the output path or deflects the sheet onto a duplex inverter roll transport 60. Transport 60 inverts and stacks the sheets to be duplexed in duplex tray 62 when gate 58 so directs. Duplex tray 62 provides intermediate or buffer storage for those sheets that have been printed on one side and on which an image will be subsequently printed on the side opposed thereto, i.e. copy sheets to be duplexed.

In order to complete duplex copying, the previously simplexed sheets in tray 62 are fed, in seriatim, by bottom feeder 64 to transfer station D for transfer of the toner powder image to the opposed side of the sheet. Conveyors 66 and rollers 68 advance the sheet along a path which produces an inversion thereof. However, inasmuch as the bottommost sheet is fed from duplex tray 62, the proper or clean side of the copy sheet is positioned in contact with belt 10 at transfer station D so that the toner powder image thereon is transferred thereto. The duplex sheets are then fed through the same path as the previously simplexed sheets to be stacked in tray 56 for subsequent removal from the printing machine by the operator.

Returning now to the operation of the printing machine, invariably after the copy sheet is separated from the photoconductive surface of belt 10, some residual particles remain adhering to belt 10. These residual particles are removed from the photoconductive surface at cleaning station F. Cleaning station F includes a rotatably mounted fiberous brush 70 in contact with the photoconductive surface of belt 10. These particles are cleaned from the photoconductive surface of belt 10 by the rotation of brush 70 in contact therewith. Subsequent to cleaning, a discharge lamp (not shown) floods the photoconductive surface with light to dissipate any residual electrostatic charge remaining thereon prior to the charging thereon for the next successive imaging cycle.

It is believed that the foregoing description is sufficient for purposes of the present application to illustrate the general operation of an electrophotographic printing machine incorporating the features of the present invention therein.

Figure 2:
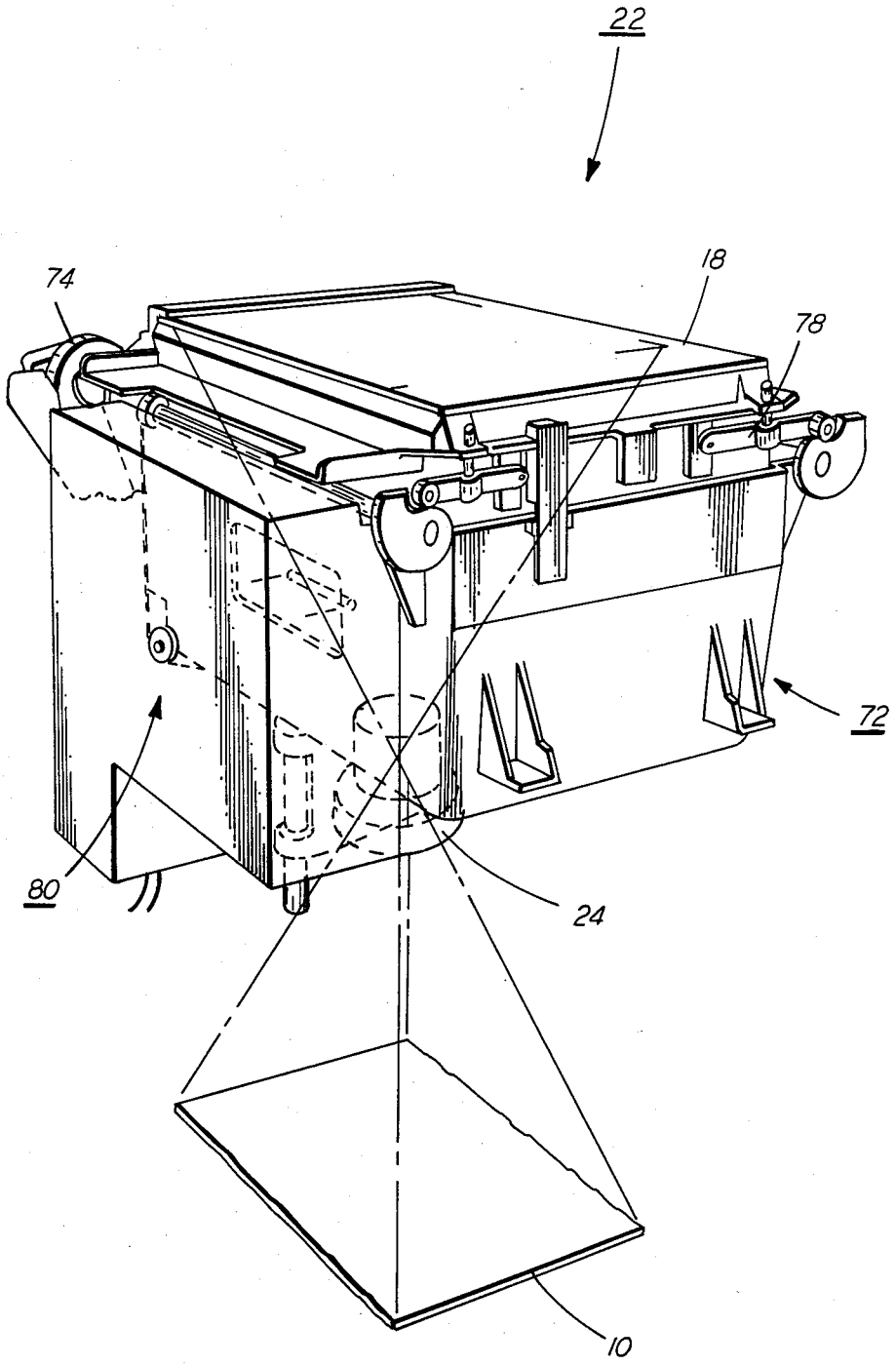
FIG. 2 is a schematic perspective view depicting the optical system used in the FIG. 1 printing machine.

Referring now to FIG. 2, the detailed structure of exposure system 22 will be described hereinafter. The magnification control system of exposure system 22 is a position automatic control system using a reversable AC motor, digital feedback encoder, and microprocessor controller to position the platen and lens so as to achieve the correct magnification and focus of images. The location of the platen and lens is controlled by cams, a band drive, and a cable attached to a capstan directly to the output drive shaft of the motor. Platen 18 is positioned on top of integrated cavity 72. Drive motor 74 is coupled to cams 76. As drive motor 74 rotates, cams 76 rotate in conjunction therewith. Rotation of cams 76 move cam followers 78. Cam followers 78 are secured to platen 18. In this manner, platen 18 is translated so as to vary the magnification of the original document being reproduced. Platen 18 is translated in a bi-directional manner. In one direction, the optical image is magnified with the optical image being reduced by movement in the opposite direction. The cam driving cable system, indicated generally by the reference numeral 80, is attached to a capstan directly coupled to the output drive shaft of motor 74. This system is also connected to lens 24. Thus, any rotation of motor 74 moves lens 24. In this manner, motor 74 drives both platen 18 and lens 24 in synchronism so as to focus the image, which may be magnified or reduced in size, onto the photoconductive surface of belt 10. Preferably, drive motor 74 is a reversable permanent capacitor AC induction gear motor. Controller 38 energizes drive motor 74 in an on/off mode in either the forward or reverse phase causing the output shaft to rotate to position platen 18 and lens 24 in accordance with the desired magnification.

Figure 3:
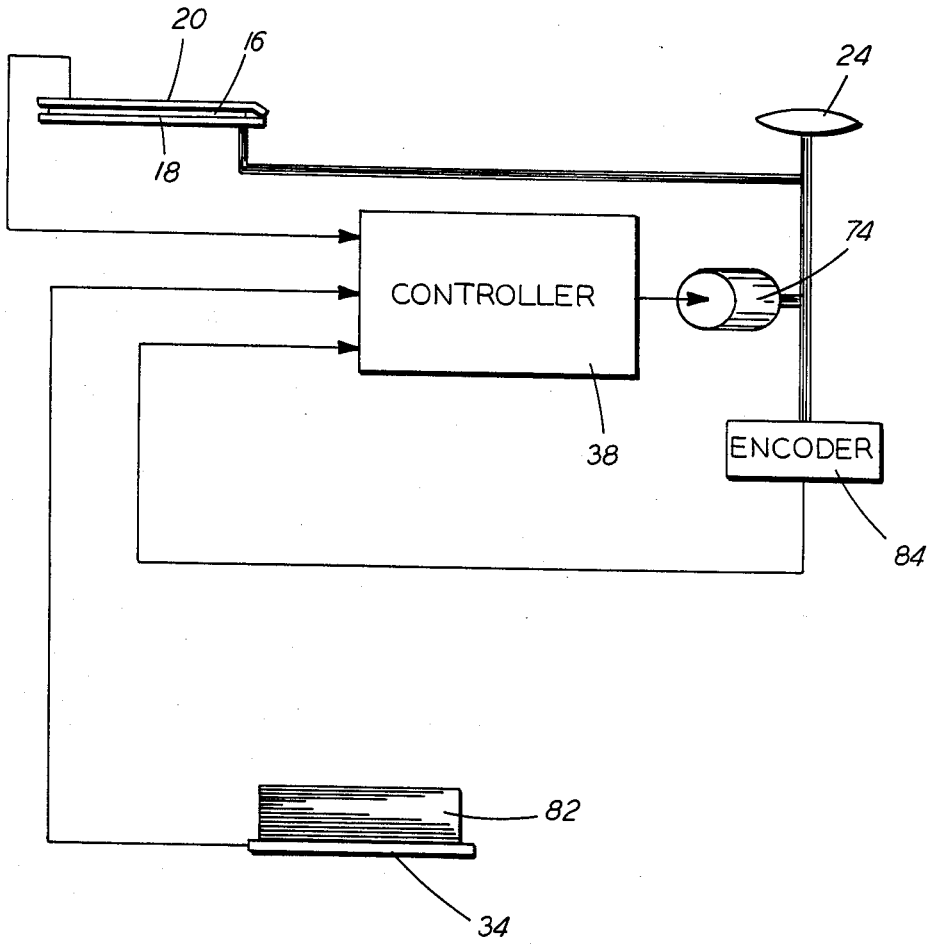
FIG. 3 is a schematic elevational view illustrating the system controlling the magnification of the optical system of FIG. 2.

Turning now to FIG. 3, there is shown the arrangement for controlling the magnification so as to insure that the information on the original document is reproduced on the copy sheet. As illustrated therein, platen 18 has original document 16 disposed thereon. Cover 20 secures the original document in place on platen 18. Sensors, located in cover 20 detect the size of original document 16 and transmit an electrical output signal indicative thereof to controller 38. Trays 34 and 36 include a magnet disposed on one end thereof which is adapted to engage one of a plurality of magnetic switches in the printing machine. Each cassette or tray 34 or 36 is of a different size corresponding to the size of the copy sheet thereon. The location of the magnet on the end of the tray and the switch actuated within the printing machine provides an indication of the size of the copy sheets in the tray. Inasmuch as trays 34 and 36 are identical with one another, only tray 34 will be described hereinafter. Tray 34 includes a magnet located at one end thereof which actuates a switch in the printing machine. The size of the copy sheets 82 in tray 34 are indicated by the switch actuated. Thus, controller 38 now receives a signal indicative of the size of the original document and the size of the copy sheet. These signals are compared and an error signal generated which is transmitted to motor 74. This error signal drives motor 74. On initiation of power-on or at the appropriate command, motor 74 will drive lens 24 and platen 18 to the home positions, which are physically established by activating a micro switch or similar detecting device. Thereafter, motor 74 will rotate and each pulse will be counted. The count relative to the home position will be compared to numbers stored in the memory register of controller 38 for the desired magnification. The numbers stored in the memory register of controller 38 is determined by the difference between the signal indicating the size of the original document and that of the copy sheet 82. When the count equals the number stored, the motor will stop and the lens and platen will be properly positioned so as to insure that information recorded on original document 16 will be reproduced on copy sheet 82. The count will be retained within controller 38 so that for the next required magnification, it is compared to the required stored number. The positive/negative aspect of the differences between the count and the stored number determined the direction of rotation of motor 74. Motor 74 is coupled to encoder 84. Encoder 84 divides the angular rotation of motor 74 into 535 equal steps through a total rotation of 180°. Each step will be about one third of a degree. Each step is counted as one pulse of encoder 84. Encoder 84 is preferably a 50% duty cycle square wave Hall effect generator which is switched by a magnet attached to the shaft of motor 74.

Figure 4:
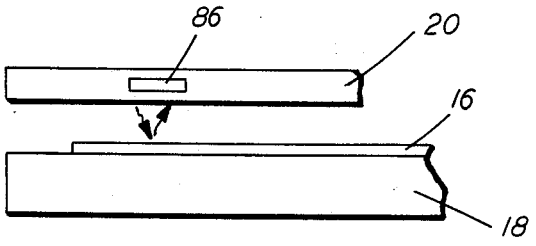
FIG. 4 is a schematic elevational view showing the manner in which the size of the original document is sensed.

Turning now to FIG. 4, there is shown a sensor 86 located in platen cover 20. Sensor 86 directs light rays onto original document 16. The light rays reflected therefrom are detected to indicate the presence of a document at that point. Sensor 86 is an integral unit consisting of a light emitter and light detector. The detailed circuitry of sensor 86 is shown in FIG. 5.

Figure 5:
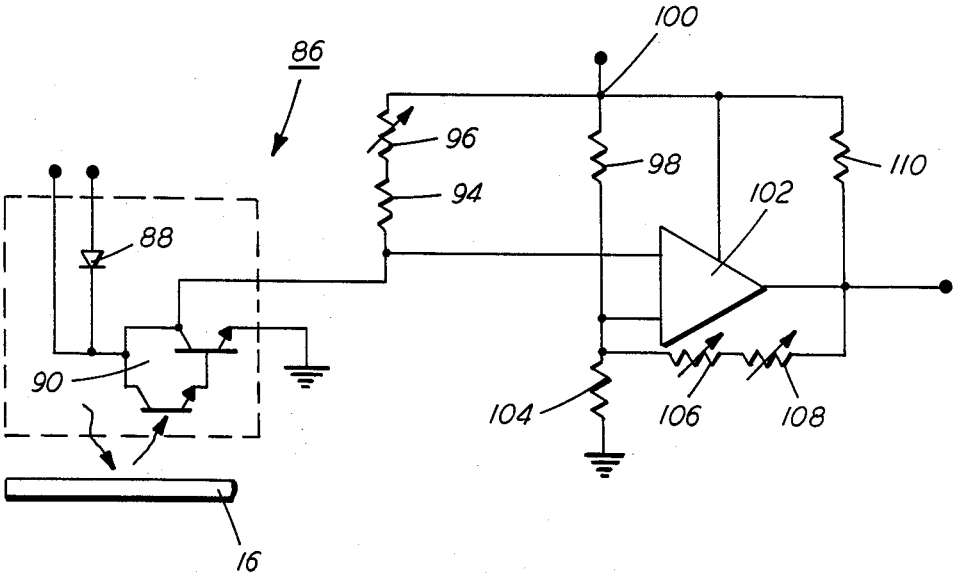
FIG. 5 is a diagram depicting the sensor circuitry.

Turning now to FIG. 5, sensor 86 comprises a light emitting diode 88 for transmitting light rays onto the surface of document 16. Phototransistor 90 detects the light rays reflected from the surface of document 16. Phototransistor 90 is coupled to a circuit indicated generally by the reference numeral 92. Circuit 92 includes a 2,000 ohm resistor 94 in series with the 5,000 ohm variable resistor 96 which is used for sensitivity control. A 20,000 ohm resistor 98 is connected in parallel with resistors 94 and 96. A reference voltage Vcc, is connected to node 100. Resistor 98 is also connected to the positive input of amplifier 102. Similarly, resistors 94 and 96 are connected to the negative input of amplifier 102. A 10,000 ohm resistor 104 is also connected to the positive input of amplifier 102. A resistor control circuit comprising a 68,000 ohm resistor 106 in series with a 500,000 ohm variable resistor 108 is connected in parallel to amplifier 102. A 1,000 ohm resistor 110 is connected across the output of amplifier 102. The output from amplifier 102 is high when original document 16 is positioned on platen 18 and is detected thereon. Alternatively, the output is low when no original document is disposed on platen 18.

Figure 6:
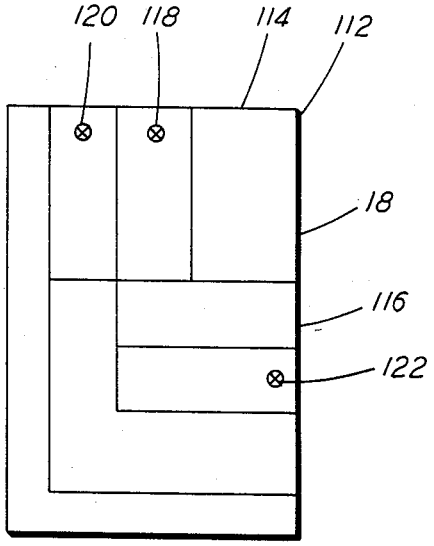
FIG. 6 is a plan view showing the position of the sensors for detecting one set of different size original documents.

Referring now to FIG. 6, there is shown the location of three sensors for determining the size of five original documents. It has been found that N sensors are required to determine the size of N+2 original documents when the original document is registered in a corner or on a corner mark of platen 18. Thus, as shown in FIG. 6, the original document would be registered in corner 112 of platen 18. Thereafter, two sensors would be located in the cover 20 along edge 114 of platen 18. One sensor is located in cover 20 along edge 116 of platen 18. Edge 114 is perpendicular to edge 116 of platen 18. Thus, sensors or detectors 118 and 120 would be located in cover 20 along edge 114 with detector 122 being located in cover 20 along edge 116. Sensor or detector 118 is located between 5.5 inches and 8.5 inches from corner registration mark or corner 112 on platen 18. Detector 120 is located in cover 20 along edge 114 a distance ranging from between 8.5 inches to 11 inches from registration mark or corner 112 of platen 18. Detector 122 is located in cover 20 along edge 116 a distance of between 11 inches and 14 inches from corner registration mark 112 on platen 18. This arrangement of sensors will permit the size of five differently sized documents to be determined. Thus, the size of the following original documents may be determined by this arrangement of sensors: 5.5×8.5; 11×8.5; 8.5×11; 8.5×14; and 11×17 inches.

Figure 7:
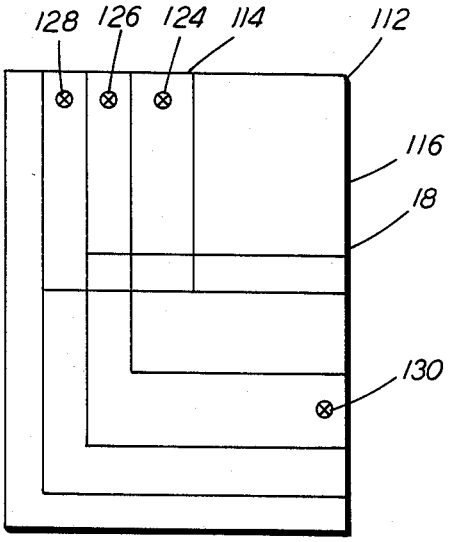
FIG. 7 is a plan view illustrating the location of the sensors for detecting a maximum number of another set of different size original documents.

Referring now to FIG. 7, here there is shown an embodiment wherein four detectors are employed to determine the size of six differently sized original documents. As shown thereat, detectors 124, 126, and 128 are located in cover 20 spaced from one another along edge 114 of platen 18. Sensor 130 is located in cover 20 along edge 116 of platen 18. Detector 124 is positioned in cover 20 a distance of between 5.83 inches and 8.27 inches from corner registration mark 112 of platen 18. Detector 126 is positioned in cover 20 a distance of between 8.27 inches and 10.12 inches from corner registration mark 112 of platen 18. Detector 128 is positioned in cover 20 a distance between 10.12 inches and 11.69 inches from corner registration mark 112 of platen 18. Detector 130 is spaced a distance of between 11.69 inches and 14.33 inches from corner registration mark 112 of platen 18 in cover 20. This arrangement of sensors will permit the size of six differently sized documents to be determined. Thus, the size of the following original documents may be determined by this arrangement of sensors: 5.83×8.27; 10.12×7.2; 11.69×8.27; 10.12×14.33; 11.69×1654; and 8.27×11.69 inches.

In recapitulation, it is clear that a minimum number of sensors may be employed to measure the size of a maximum number of differently sized original documents. Hence, N+2 differently sized documents may have their size determined by N detectors appropriately positioned relative thereto. With the knowledge of the size of the original document and similar information with respect to the copy sheet, the magnification of the printing machine may be suitably adjusted to insure that the information from the original document fits on the copy sheet.

It is, therefore, evident that this invention fully satisifies the aims and advantages hereinbefore set forth. While this invention has been described in conjunction with a specific embodiment thereof, it is evident that many alteratives, modifications, and variations will be apparent to those skilled in the art. Accordingly, it is intended to embrace all such alternatives, modifications, and variations as fall within the spirit and broad scope of the appended claims.

I claim:

1. An electrophotographic printing machine of the type having a platen for supporting an original document thereon, a photoconductive member arranged to have at least a portion of the surface thereof charged, a variable magnification optical system adapted to expose the charged portion of the photoconductive member to a light image of the original document recording an electrostatic latent image thereon, means for developing the electrostatic latent image to form a toner image on the photoconductive member, and means for transferring the toner image from the photoconductive member to a copy sheet, wherein the improvement includes:

means for sensing the size of the original document with the original document being selected from a set of different size original documents with the size of each original document of the set being predetermined, said sensing means comprising N detectors mounted fixedly relative to the original document supported on the platen to measure N+2 different size original documents;

means for measuring the size of the copy sheet; and means for comparing the size of the copy to the size of the original document and generating an error signal indicative of the difference therebetween.

2. A printing machine according to claim 1, wherein the original document is positioned on the platen with a corner thereof in registration with a corner registration mark on the platen.

3. A printing machine according to claim 2, wherein said sensing means includes a plurality of detectors spaced along a first marginal edge of the platen.

4. A printing machine according to claim 3, wherein said sensing means includes at least one detector located along a second marginal edge of the platen with the second marginal edge being substantial perpendicular to the first marginal edge.

5. A printing machine according to claim 4, wherein N−1 detectors are spaced along the first marginal edge of the platen.

6. A printing machine according to claim 5, wherein one detector is located along the second marginal edge of the platen.

7. A printing machine according to claim 6, wherein said sensing means includes three detectors to measure the size of five original documents with the size of the original documents being about 5.5 inches×8.5 inches, 11 inches×8.5 inches, 8.5 inches×11 inches, 8.5 inches×14 inches, and 11 inches×17 inches.

8. A printing machine according to claim 7, wherein said sensing means includes a first detector located between 5.5 inches and 8.5 inches from the corner registration mark on the platen along the first marginal edge of the platen, a second detector spaced from said first detector, located between 8.5 inches and 11 inches from the corner registration mark on the platen along the first marginal edge of the platen, and a third detector located between 11 inches and 14 inches from the corner registration mark on the platen along the second marginal edge of the platen.

9. A printing machine according to claim 6, wherein said sensing means includes four detectors to measure the size of six original documents with the size of the original documents being about 5.83 inches×8.27 inches, 11.69 inches×8.27 inches, 8.27 inches×11.69 inches, 10.12 inches×14.33 inches, 10.12 inches×7.2 inches, and 11.69 inches×16.54 inches.

10. A printing machine according to claim 9, wherein said sensing means includes a first detector located between 5.83 inches and 8.27 inches from the corner registration mark on the platen along the first marginal edge of the platen, a second detector spaced from said first detector, located between 8.27 inches and 10.12 inches from the corner registration mark on the platen along the first marginal edge, a third detector, spaced from said second detector, located between 10.12 inches and 11.69 inches from the corner registration mark on the platen along the first marginal edge of the platen, and a fourth detector located between 11.69 inches and 14.33 inches from the corner registration mark on the platen along the second marginal edge of the platen.

11. A printing machine according to claim 6, further including means for covering the original document on the platen.

12. A printing machine according to claim 11, wherein said sensing means is mounted in said covering means.

13. A printing machine according to claim 12, wherein the error signal from said comparing means adjusts the optical system so that the information of the original document fits on the copy sheet.

* * * * *